US009902042B2

(12) United States Patent
Bird

(10) Patent No.: US 9,902,042 B2
(45) Date of Patent: Feb. 27, 2018

(54) POLYCRYSTALLINE DIAMOND, METHODS OF FORMING SAME, CUTTING ELEMENTS, AND EARTH-BORING TOOLS

(71) Applicant: Baker Hughes Incorporated, Houston, TX (US)

(72) Inventor: Marc W. Bird, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 331 days.

(21) Appl. No.: 14/668,524

(22) Filed: Mar. 25, 2015

(65) Prior Publication Data

US 2016/0279761 A1 Sep. 29, 2016

(51) Int. Cl.

| | |
|---|---|
| ***E21B 10/55*** | (2006.01) |
| ***B24D 3/06*** | (2006.01) |
| ***B24D 18/00*** | (2006.01) |
| ***E21B 10/567*** | (2006.01) |

(52) U.S. Cl.
CPC ..... *B24D 3/06* (2013.01); *B24D 18/0009* (2013.01); *E21B 10/55* (2013.01); *E21B 10/567* (2013.01)

(58) Field of Classification Search
CPC ... B24D 3/04; B24D 3/06; B24D 7/00; B24D 18/0009
See application file for complete search history.

(56) References Cited

U.S. PATENT DOCUMENTS 3,745,623 A * 7/1973 Wentorf, Jr. ..... B01J 3/062 407/119
3,924,031 A * 12/1975 Nicholas ..... C09K 3/1445 427/217
4,084,942 A * 4/1978 Villalobos ..... B82Y 10/00 264/102
4,224,380 A 9/1980 Bovenkerk et al.
4,594,294 A * 6/1986 Eichen ..... A61C 3/02 204/192.15
4,778,486 A * 10/1988 Csillag ..... B24D 3/34 264/122
5,127,923 A 7/1992 Bunting et al.
(Continued)

OTHER PUBLICATIONS

Bundy et al., Diamond Graphite Equilibrium Line from Growth and Graphitization of Diamond, J. of Chem. Phys., vol. 35, (1961), pp. 383-391.

(Continued)

*Primary Examiner* — Pegah Parvini
(74) *Attorney, Agent, or Firm* — TraskBritt

(57) ABSTRACT

A method of forming polycrystalline diamond includes providing an alloy over diamond particles and subjecting the diamond particles to a pressure of at least 4.5 GPa and a temperature of at least 1,000° C. to form inter-granular bonds. The alloy includes iridium and at least one of copper, silver, and gold. A polycrystalline diamond compact includes diamond grains bonded by inter-granular bonds and an alloy disposed within interstitial spaces. The alloy includes iridium, carbon, and at least one of copper, silver, and gold. An earth-boring tool includes a bit body and a polycrystalline diamond compact secured to the bit body. Some methods include selecting an alloy that is catalytic to formation of diamond-to-diamond bonds when the alloy is in a liquid phase, but non-catalytic to the back-conversion of diamond to graphite at temperatures of less than about 1,000° C.

19 Claims, 4 Drawing Sheets

(56) References Cited

U.S. PATENT DOCUMENTS

| | | | | |
|---|---|---|---|---|
| 8,496,076 | B2 | 7/2013 | DiGiovanni et al. | |
| 8,579,052 | B2 | 11/2013 | DiGiovanni et al. | |
| 8,727,042 | B2 | 5/2014 | DiGiovanni | |
| 2009/0260895 | A1* | 10/2009 | Vail | B01J 3/062 175/434 |
| 2010/0122852 | A1* | 5/2010 | Russell | C22C 26/00 175/428 |
| 2010/0206941 | A1* | 8/2010 | Egan | C09K 3/1445 228/221 |

OTHER PUBLICATIONS

Bundy et al., Diamond Synthesis with Non-Conventional Catalyst-Solvents, Nature, vol. 241, (1973), pp. 116-118.
Cannon, J. F., Behavior of the Elements at High Pressures, J. Phys. Chem. Ref. Data, vol. 3, No. 3, (1974), pp. 781-824.
Chakrabarti et al., The Cu—Ir (Copper-Iridium) Equil. vol. 5, No. 4, (1984), pp. 378-379.
C—Ir, Data from SGTE 2011 Alloy Database, FactSage (2014), 1 page.
Cu—Ir, Phase Diagrams of Binary Alloy Systems, Metals Handbook 8th Edition, American Society for Metals, vol. 8, p. 294.
Karakaya et al., The Ag—C (Silver-Carbon) System, J. of Phase Equil. vol. 9, No. 3, (1988), pp. 226-227.
Karakaya et al., The Ag—Ir (Silver-Iridium) System, J. of Phase Equil., vol. 7, No. 4, (1986), pp. 359-360.
Okamoto et al., The Au—Ir (Gold-Iridium) System, J. of Phase Equil., vol. 5, No. 4, (1984), p. 381.
Sung et al., Graphite to Diamond Transition under High Pressure A Knetics Approach, J. of Mat. Sci., vol. 35, (2000), pp. 6041-6054.
Sung et al., Reactivities of Transition Metals with Carbon Implications to the Mechanism of Diamond Synthesis Under High Pressure, Int. J. of Ref. Met. & Hart Mat., vol. 15, (1997), pp. 237-256.
Underwood, Quantitative Stereology, Addison-Wesley Publishing Company, Inc., 1970, pp. 103 105.
Okamoto et al., The Au—C (Gold-Carbon) System, Bulletin of Alloy Phase Diagrams, vol. 5, No. 4, (1984), pp. 378-379.
Cu—C Binary Phase Diagram, unknown author, unknown date, 2 pages.
A T Dinsdale, SGTE Data for Pure Elements, Calphad 15(1991) 4 p. 317-425.
Cu—Ir, Phase Diagrams of Binary Alloy Systems, Metals Handbook 8th Edition, American Society for Metals, vol. 8, p. 274.

* cited by examiner

POLYCRYSTALLINE DIAMOND, METHODS OF FORMING SAME, CUTTING ELEMENTS, AND EARTH-BORING TOOLS

FIELD

Embodiments of the present disclosure relate generally to polycrystalline hard materials, cutting elements, earth-boring tools, and method of forming such materials, cutting elements, and tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller-cone earth-boring rotary drill bits include cones that are mounted on bearing pins extending from legs of a bit body such that each cone is capable of rotating about the bearing pin on which the cone is mounted. A plurality of cutting elements may be mounted to each cone of the drill bit.

The cutting elements used in earth-boring tools often include polycrystalline diamond compact (often referred to as "PDC") cutters, which are cutting elements that include a polycrystalline diamond (PCD) material. Such polycrystalline diamond cutting elements are formed by sintering and bonding together relatively small diamond grains or crystals under conditions of high pressure and high temperature, typically in the presence of a catalyst (such as cobalt, iron, nickel, or alloys and mixtures thereof), to form a layer of polycrystalline diamond material on a cutting element substrate. These processes are often referred to as high-pressure/high-temperature (or "HPHT") processes. Catalyst material is mixed with the diamond grains to reduce the amount of oxidation of diamond by oxygen and carbon dioxide during an HPHT process and to promote diamond-to-diamond bonding.

The cutting element substrate may include a cermet material (i.e., a ceramic-metal composite material) such as cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation.

Traditional PDC performance relies on the catalyst alloy, which sweeps through the compacted diamond feed during HPHT synthesis. Traditional catalyst alloys are cobalt-based with varying amounts of nickel, tungsten, and chromium to facilitate diamond intergrowth between the compacted diamond material. However, in addition to facilitating the formation of diamond-to-diamond bonds during HPHT sintering, these alloys also facilitate the formation of graphite from diamond during drilling. Formation of graphite can rupture diamond necking regions (i.e., grain boundaries) due to an approximate 57% volumetric expansion during the transformation. This phase transformation is known as "back-conversion" or "reverse graphitization," and typically occurs at temperatures approaching 600° C. to 1,000° C., near cutting temperatures experienced during drilling applications. This mechanism, coupled with mismatch of the coefficients of thermal expansion of the metallic phase and diamond is believed to account for a significant part of the general performance criteria known as "thermal stability." From experimental wear conditions, "back-conversion" appears to dominate the thermal stability of a PCD, promoting premature degradation of the cutting edge and performance.

To reduce problems associated with different rates of thermal expansion and with back-conversion in polycrystalline diamond cutting elements, so-called "thermally stable" polycrystalline diamond (TSD) cutting elements have been developed. A TSD cutting element may be formed by leaching the catalyst material (e.g., cobalt) out from interstitial spaces between the diamond grains in the diamond table using, for example, an acid. Substantially all of the catalyst material may be removed from the diamond table, or only a portion may be removed. TSD cutting elements in which substantially all catalyst material has been leached from the diamond table have been reported to be thermally stable up to temperatures of about 1,200° C. It has also been reported, however, that fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, a method of forming polycrystalline diamond includes providing an alloy over at least portions of a plurality of diamond particles and subjecting the plurality of diamond particles to a pressure of at least 4.5 GPa and a temperature of at least 1,000° C. to form inter-granular bonds between adjacent diamond particles. The alloy includes iridium and at least one metal selected from the group consisting of copper, silver, and gold.

In other embodiments, a method of forming polycrystalline diamond includes selecting an alloy that is catalytic to formation of diamond-to-diamond bonds when the alloy is in a liquid phase, but non-catalytic to the back-conversion of diamond to graphite at temperatures of less than about 1,000° C. The method also includes providing the alloy over at least portions of a plurality of particles of diamond and subjecting the alloy and the plurality of particles of diamond to high-pressure high-temperature (HPHT) conditions at a temperature of at least a melting temperature of the alloy to form inter-granular bonds between the particles of diamond to form polycrystalline diamond.

A polycrystalline diamond compact may include a plurality of diamond grains bonded to one another by inter-granular bonds and an alloy disposed within interstitial spaces between the inter-bonded diamond grains. The alloy includes iridium, carbon, and at least one metal selected from the group consisting of copper, silver, and gold. The alloy exhibits a melting point of less than about 1,300° C.

An earth-boring tool may include a bit body and a polycrystalline diamond compact secured to the bit body. The polycrystalline diamond compact includes a plurality of grains of diamond material bonded to one another by inter-granular bonds and an alloy disposed within interstitial spaces between the inter-bonded diamond grains of the diamond matrix. The alloy includes iridium, carbon, and at least one metal selected from the group consisting of copper, silver, and gold.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular cutting elements or tools, but are merely idealized representations that are employed to describe example embodiments of the present disclosure. Additionally, elements common between figures may retain the same numerical designation.

As used herein, the term "particle" means and includes any coherent volume of solid matter having an average dimension of about 500 μm or less. Grains (i.e., crystals) and coated grains are types of particles. As used herein, the term "nanoparticle" means and includes any particle having an average particle diameter of about 500 nm or less. Nanoparticles include grains in a polycrystalline hard material having an average grain size of about 500 nm or less.

As used herein, the term "hard material" means and includes any material having a Knoop hardness value of about 3,000 $Kg_f/mm^2$ (29,420 MPa) or more. Hard materials include, for example, diamond and cubic boron nitride.

As used herein, the term "inter-granular bond" means and includes any direct atomic bond (e.g., covalent, metallic, etc.) between atoms in adjacent grains of material.

As used herein, the terms "nanodiamond" and "diamond nanoparticles" mean and include any single or polycrystalline or agglomeration of nanocrystalline carbon material comprising a mixture of $sp^3$ and $sp^2$ bonded carbon wherein the individual particle or crystal whether singular or part of an agglomerate is primarily made up of $sp^3$ bonds. Commercial nanodiamonds are typically derived from ultradispersed diamond (UDD) detonation sources and crushed sources and can be naturally occurring or manufactured synthetically. Naturally occurring nanodiamond includes the natural lonsdaleite phase identified with meteoric deposits.

As used herein, the term "polycrystalline hard material" means and includes any material comprising a plurality of grains or crystals of the material that are bonded directly together by inter-granular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising inter-granular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Figure 1:
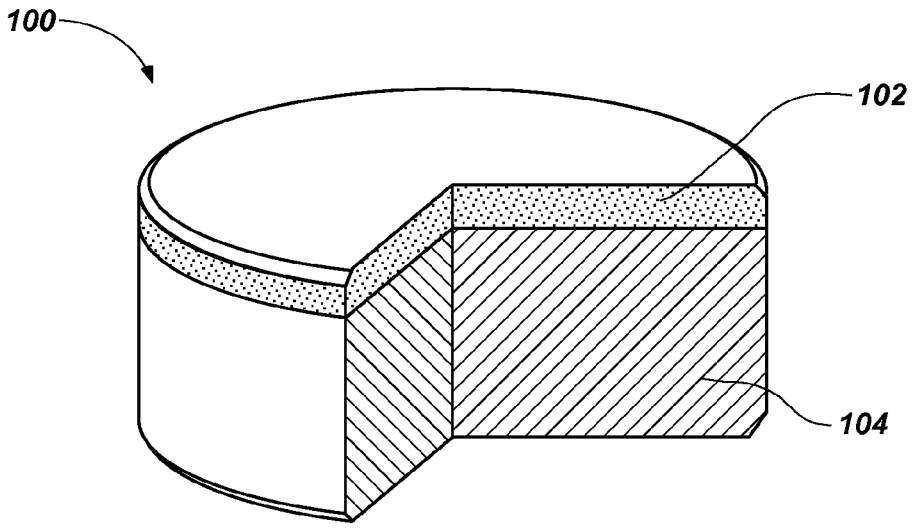
FIG. 1 is a partially cut-away perspective view of an embodiment of a cutting element (i.e., a polycrystalline compact) including a volume of polycrystalline hard material on a substrate.

FIG. 1 illustrates a cutting element 100, which may be formed as disclosed herein. The cutting element 100 includes a polycrystalline hard material 102. Typically, the polycrystalline hard material 102 may be polycrystalline diamond, but may include other hard materials instead of or in addition to polycrystalline diamond. For example, the polycrystalline hard material 102 may include cubic boron nitride. Optionally, the cutting element 100 may also include a substrate 104 to which the polycrystalline hard material 102 may be bonded, or on which the polycrystalline hard material 102 is formed under the aforementioned HPHT conditions. For example, the substrate 104 may include a generally cylindrical body of cobalt-cemented tungsten carbide material, although substrates of different geometries and compositions may also be employed. The polycrystalline hard material 102 may be in the form of a table (i.e., a layer) of polycrystalline hard material 102 on the substrate 104, as shown in FIG. 1. The polycrystalline hard material 102 may be provided on (e.g., formed on or secured to) a surface of the substrate 104. In additional embodiments, the cutting element 100 may simply be a volume of the polycrystalline hard material 102 having any desirable shape, and may not include any substrate 104. The cutting element 100 may be referred to as "polycrystalline compact," or, if the polycrystalline hard material 102 includes diamond, as a "polycrystalline diamond compact."

Figure 2:
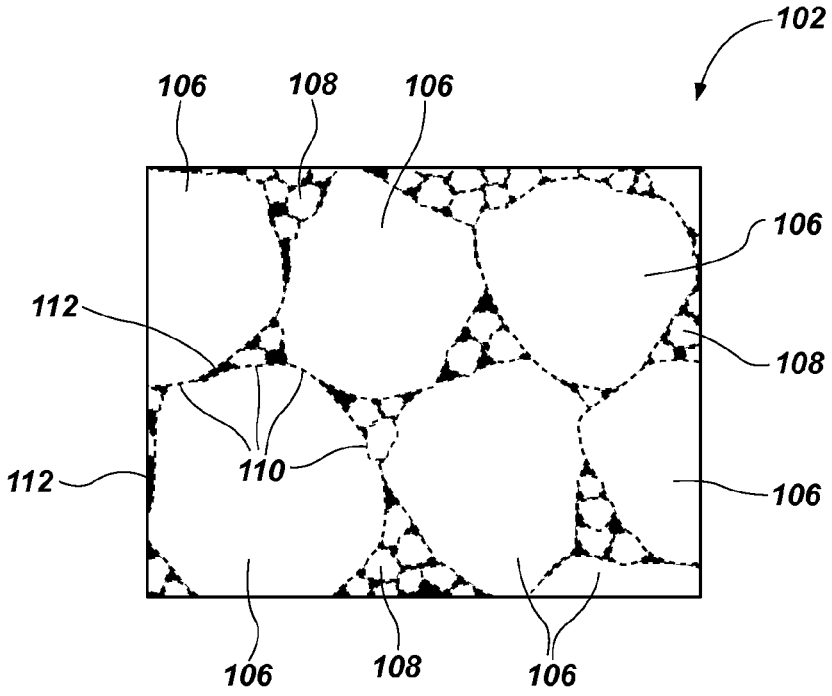
FIG. 2 is a simplified view illustrating how a microstructure of the polycrystalline hard material of the cutting element of FIG. 1 may appear under magnification.

As shown in FIG. 2, the polycrystalline hard material 102 may include interspersed and inter-bonded grains forming a three-dimensional network of hard material. Optionally, in some embodiments, the grains of the polycrystalline hard material 102 may have a multimodal (e.g., bi-modal, tri-modal, etc.) grain size distribution. For example, the polycrystalline hard material 102 may comprise a multi-modal grain size distribution as disclosed in at least one of U.S. Pat. No. 8,579,052, issued Nov. 12, 2013, and titled "Polycrystalline Compacts Including In-Situ Nucleated Grains, Earth-Boring Tools Including Such Compacts, and Methods of Forming Such Compacts and Tools"; U.S. Pat. No. 8,727,042, issued May 20, 2014, and titled "Polycrystalline Compacts Having Material Disposed in Interstitial Spaces Therein, and Cutting Elements Including Such Compacts"; and U.S. Pat. No. 8,496,076, issued Jul. 30, 2013, and titled "Polycrystalline Compacts Including Nanoparticulate Inclusions, Cutting Elements and Earth-Boring Tools Including Such Compacts, and Methods of Forming Such Compacts"; the disclosures of each of which are incorporated herein in their entireties by this reference.

For example, in some embodiments, the polycrystalline hard material 102 may include larger grains 106 and smaller grains 108. The larger grains 106 and/or the smaller grains 108 may have average particle dimensions (e.g., mean diameters) of less than 0.5 mm, less than 0.1 mm, less than 0.01 mm, less than 1 μm, less than 0.1 μm, or even less than 0.01 μm. That is, the larger grains 106 and smaller grains 108 may each include micron-sized particles (grains having an average particle diameter in a range from about 1 μm to about 500 μm (0.5 mm)), submicron-sized particles (grains having an average particle diameter in a range from about 500 nm (0.5 μm) to about 1 μm), and/or nanoparticles (particles having an average particle diameter of about 500 nm or less). In some embodiments, the larger grains 106 may be micron-sized diamond particles, and the smaller grains 108 may be submicron diamond particles or diamond nanoparticles. In some embodiments, the larger grains 106 may be submicron diamond particles, and the smaller grains 108 may be diamond nanoparticles. In other embodiments, the grains of the polycrystalline hard material 102 may have a monomodal grain size distribution. The polycrystalline hard material 102 may include direct inter-granular bonds 110 between the grains 106, 108, represented in FIG. 2 by dashed lines. If the grains 106, 108 are diamond particles, the direct inter-granular bonds 110 may be diamond-to-diamond bonds. Interstitial spaces are present between the inter-bonded grains 106, 108 of the polycrystalline hard material 102. In some embodiments, some of these interstitial spaces may include empty voids within the polycrystalline hard material 102 in which there is no solid or liquid substance (although a gas, such as air, may be present in the voids). An alloy material 112 may reside in some or all of the interstitial spaces unoccupied by the grains 106, 108 of the polycrystalline hard material 102.

As used herein, the term "grain size" means and includes a geometric mean diameter measured from a two-dimensional section through a bulk material. The geometric mean diameter for a group of particles may be determined using techniques known in the art, such as those set forth in Ervin E. Underwood, QUANTITATIVE STEREOLOGY, 103-105 (Addison-Wesley Publishing Company, Inc., 1970), the disclosure of which is incorporated herein in its entirety by this reference. As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a polycrystalline hard material 102 (e.g., a polished and etched surface of the polycrystalline hard material 102). Commercially available vision systems are often used with such microscopy systems, and these vision systems are capable of measuring the average grain size of grains within a microstructure.

Referring again to FIG. 2, the alloy material 112 may include a material that is catalytic to the formation of inter-granular bonds 110 under certain conditions. For example, the alloy material 112 may be catalytic to the formation of diamond-to-diamond bonds when the alloy material 112 is in a liquid phase. The alloy material 112 may not be catalytic to the formation of inter-granular bonds 110 under other conditions. For example, the alloy material 112 may be non-catalytic to the formation of diamond-to-diamond bonds when the alloy material 112 is in a solid phase. The alloy material 112 may be a single-phase solid solution that does not promote or catalyze back-conversion of diamond to graphite when the alloy material 112 is in solid form and at temperatures of about 1,000° C. and below, which are typical temperatures to which the materials may be exposed during use of the cutting element in an earth-boring tool. The alloy material 112 may be substantially free of intermetallic phases. The alloy material 112 may exhibit a melting temperature from about 1,000° C. to about 1,500° C., such as from about 1,200° C. to about 1,400° C.

In some embodiments, the alloy material 112 may include carbon, iridium, and a metal in Group IB (Group 11) of the periodic table of elements. That is, the alloy material 112 may include carbon, iridium, and one or more of copper, silver, and gold. The alloy material 112 may also include other elements. The alloy material 112 may be formed by diffusing carbon into a precursor of the alloy material 112 during HPHT sintering, such as a binary mixture of iridium and the Group IB metal. By way of non-limiting example, the alloy material 112 may be formed from a mixture containing from about 0.001% to about 15% iridium by weight, such as from about 0.01% to about 15% iridium by weight, from about 0.1% to about 15% iridium by weight, from about 1% to about 2% iridium by weight, from about 5% to about 11% iridium by weight, from about 0.001% to about 2% iridium by weight, or from about 0.1% to about 2% iridium by weight, with the balance being the Group IB metal. The alloy material 112 may have substantially similar compositions to those described herein, but for the addition of carbon diffused into the alloy material 112 during HPHT sintering. The amount of carbon may depend on the solubility of carbon in the alloy material 112 (e.g., the eutectic point) at HPHT conditions. For example, the alloy material 112 may contain up to about 4% carbon by weight (about 2.0 mol % carbon).

For example, an alloy material 112 containing carbon, iridium, and copper may be formed from a mixture including from about 0.001% to about 15% iridium by weight, such as from about 1% to about 2% iridium by weight. An alloy material 112 containing carbon, iridium, and silver may be formed from a mixture including, for example, from about 0.001% to about 2% iridium by weight. An alloy material 112 containing carbon, iridium, and gold may be formed from a mixture including, for example, from about 1% to about 2% iridium by weight. The alloy material 112 may be, in some embodiments, substantially free of elements of group VIIIA (i.e., groups 8, 9, and 10) of the periodic table. For example, the alloy material 112 may be substantially free of iron, cobalt, and nickel.

In a volume of polycrystalline hard material, the hard material typically occupies less than 100% of the total volume due to the inclusion of interstitial spaces. The polycrystalline hard material 102 described herein and shown in FIGS. 1 and 2, having the alloy material 112 in interstitial spaces, may exhibit a relatively higher volume percentage of polycrystalline material than conventional polycrystalline hard materials. For example, the polycrystalline hard material 102 may include at least about 90% hard material by volume, such as at least about 94% hard material by volume, at least about 95% hard material by volume, at least about 96% hard material by volume, or even at least about 97% hard material by volume. The volume fraction of hard material may be relatively higher than conventional materials at least in part because the interstitial spaces may be relatively smaller than in conventional materials. In general, higher volume fractions of hard materials may exhibit better cutting performance.

Figure 3:
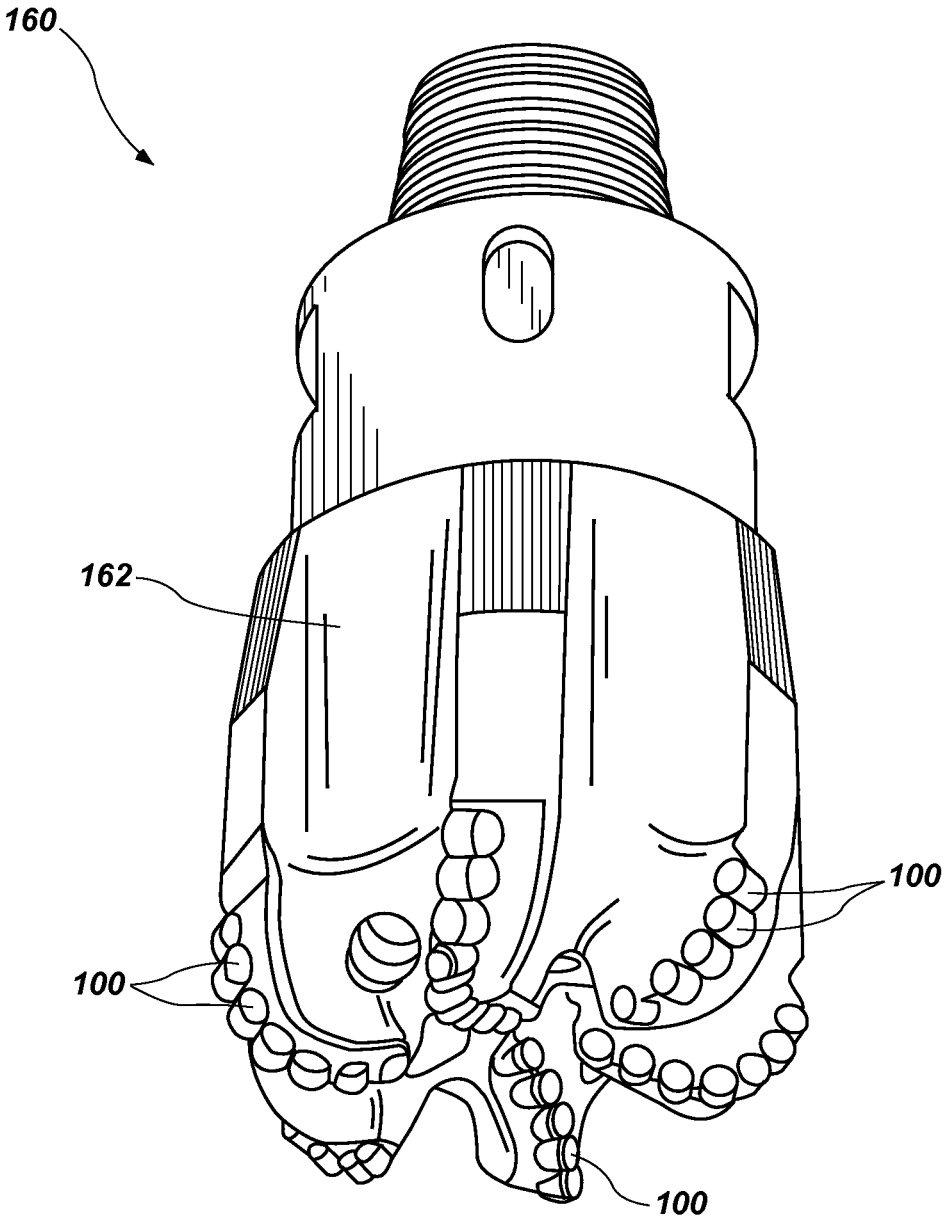
FIG. 3 illustrates an earth-boring rotary drill bit comprising cutting elements as described herein.

Embodiments of cutting elements 100 (FIG. 1) that include polycrystalline hard material 102 fabricated as described herein may be mounted to earth-boring tools and used to remove subterranean formation material. FIG. 3 illustrates a fixed-cutter earth-boring rotary drill bit 160. The drill bit 160 includes a bit body 162. One or more cutting elements 100 as described herein may be mounted on the bit body 162 of the drill bit 160. The cutting elements 100 may be brazed or otherwise secured within pockets formed in the outer surface of the bit body 162. Other types of earth-boring tools, such as roller cone bits, percussion bits, hybrid bits, reamers, etc., also may include cutting elements 100 as described herein.

Figure 4:
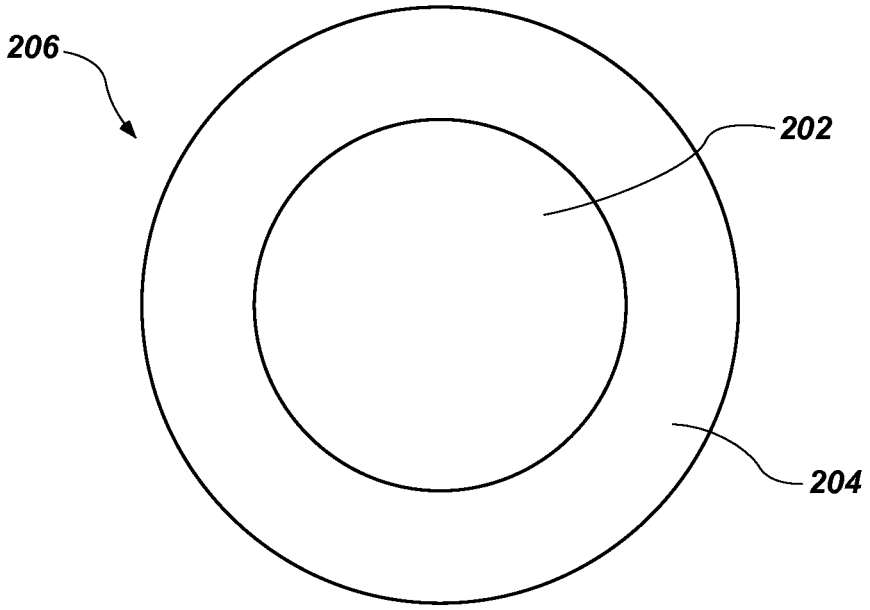
FIG. 4 is a simplified drawing of a coated particle that may be used to form a cutting element like that of FIGS. 1 and 2 in accordance with some embodiments of methods described herein.

In some embodiments, methods of forming polycrystalline hard material may include HPHT sintering of a hard material and an alloy material to form inter-granular bonds between the particles of hard material. The hard material and alloy material may be placed into contact with one another before sintering. For example, the alloy material may be provided over grains or particles of hard material (e.g., as a coating) before sintering. Referring now to FIG. 4, a grain 202 of hard material (e.g., diamond, cubic boron nitride, etc.) may be at least partially coated with an alloy material 204 to form a coated grain 206. Though depicted in FIG. 4 as completely encapsulating the grain 202, the alloy material 204 may cover only a portion of an exterior surface of the grain 202. For example, the alloy material 204 may cover an average of at least about 30% of the surface area of grains 202 in a particle mixture to be sintered. In some embodiments, the alloy material 204 may cover an average from about 70% to about 100% of the surface area of grains 202 in a particle mixture to be sintered, or at least about 90% of the surface area of grains 202. The alloy material 204 may be in a continuous formation over each grain 202, such that even if the alloy material 204 does not coat the entire grain 202, there may be little to no "islands" of alloy material 204 disconnected from the remainder of the alloy material 204 on the grain 202.

The alloy material 204 may be formed to have any selected thickness, although relatively thin and uniform coatings may be desirable. For example, the alloy material 204 may have an average thickness from about 1 nanometer (nm) to about 20 nm, or from about 1 nm to about 2 nm.

The coated grains 206 may be formed by, for example, sputtering, physical vapor deposition, chemical vapor deposition, or any other process known in the art. For example, sputtering of the alloy material 204 onto the grains 202 may be performed by DC, pulsed-DC, or RF magnetron sputtering. The alloy material 204 may be provided to a sputtering system as prealloyed material or as individual commercially pure metals (e.g., powders, billets, etc.). The sputtering system may deposit the alloy material 204 in a substantially uniform thickness over the grains 202. The sputtering system may control the composition and thickness of the alloy material 204.

One advantage of using iridium as a component of the alloy material 204 is that iridium may promote fine-grained microstructures, which may facilitate the deposition of coatings that are of thin and uniform thickness. For example, diamond particles having grain sizes from about 10 nm to about 0.5 μm may be coated relatively uniformly when the alloy material 204 contains iridium at the concentrations disclosed herein. The sputtering power and gas pressure (plasma) may be controlled to produce a selected composition and thickness of the alloy material 204.

Sputtering processes may occur under an initial high vacuum, such as at a pressure of less than about $10^{-7}$ torr. Working pressures during sputtering may be varied by increasing or decreasing argon or other inert gas flow rates. In this manner, the sputtering rates of materials (e.g., prealloyed material or individual commercially pure elements) may be varied as desired to control compositions and/or thickness. If the alloy material to be sputtered is provided in powder form, a continuously rotating apparatus may be used in-situ during sputtering for promoting uniform coating thickness, alloy composition, and powder surface coverage. For example, grains 202 may be placed in a ball mill with grinding media. The ball mill may be subjected to a vacuum, and the alloy material 204 may be sputtered onto the grains 202 while the ball mill rotates.

Figure 5:
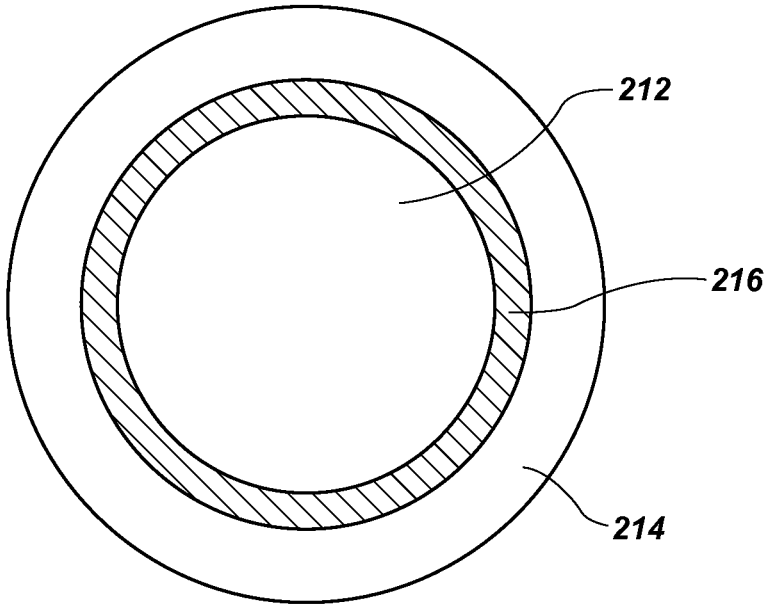
FIG. 5 is a simplified drawing of another coated particle that may be used to form a cutting element like that of FIGS. 1 and 2 in accordance with some embodiments of methods described herein.

In some embodiments, and as shown in FIG. 5, a diamond grain 212 may include a non-diamond carbon coating 216 or layer, which may be referred to as a carbon shell. The non-diamond carbon coating 216 may include, for example, graphite, graphene, fullerenes, amorphous carbon, or any other carbon phase or morphology. An alloy material 214 may be formed over the non-diamond carbon coating 216. The alloy material 214 may be formed in a similar manner as described above with respect to the alloy material 204 shown in FIG. 4. Although the non-diamond carbon coating 216 and the alloy material 214 are depicted in FIG. 5 as completely encapsulating the diamond grain 212, in other embodiments, they may only partially coat the diamond grain 212. The diamond grain 212 may include a single diamond crystal or a cluster of diamond crystals.

The non-diamond carbon coating 216 may react with the alloy material 214 to form the alloy material 112 shown in FIG. 2. In some embodiments, at least a portion of the non-diamond carbon coating 216 may undergo a change in atomic structure during or prior to sintering. Some carbon atoms in the non-diamond carbon coating 216 may diffuse to and enter the diamond crystal structure of the diamond grain 212 (i.e., contribute to grain growth of the diamond grain 212). Some carbon atoms in the non-diamond carbon coating 216 may diffuse to and enter the alloy material 214.

In some embodiments, grains 202 (FIG. 4) or and/or grains 212 (FIG. 5) may be tumbled with an inert media to break down aggregates and promote uniform coating. Additionally, grains 202, 212 may be pretreated to reduce aggregation and improve the flow of grains 202, 212 during coating processes. For example, grains 202, 212 may be pretreated with hydrogen to remove oxygen-, nitrogen- and water-bearing surface impurities and/or to functionalize the surfaces with methyl and methylene groups. Additional functionalization, such as long-alkyl-chain or fluorine compounds, may be employed for nano-diamond particles. Coated grains 202, 212 may include monomodal nanometer- or micron-diamond feed or composite blends of nano- and micron-diamond feed having nano-diamond compositions from about 1% by weight to about 99% by weight. Additional multimodal nanodiamond or multimodal micron-diamond feed may also be coated and subsequently dry-blended, forming composite blends. The final coated feed product may be sintered at HPHT conditions as discussed in more detail below.

Figure 6:
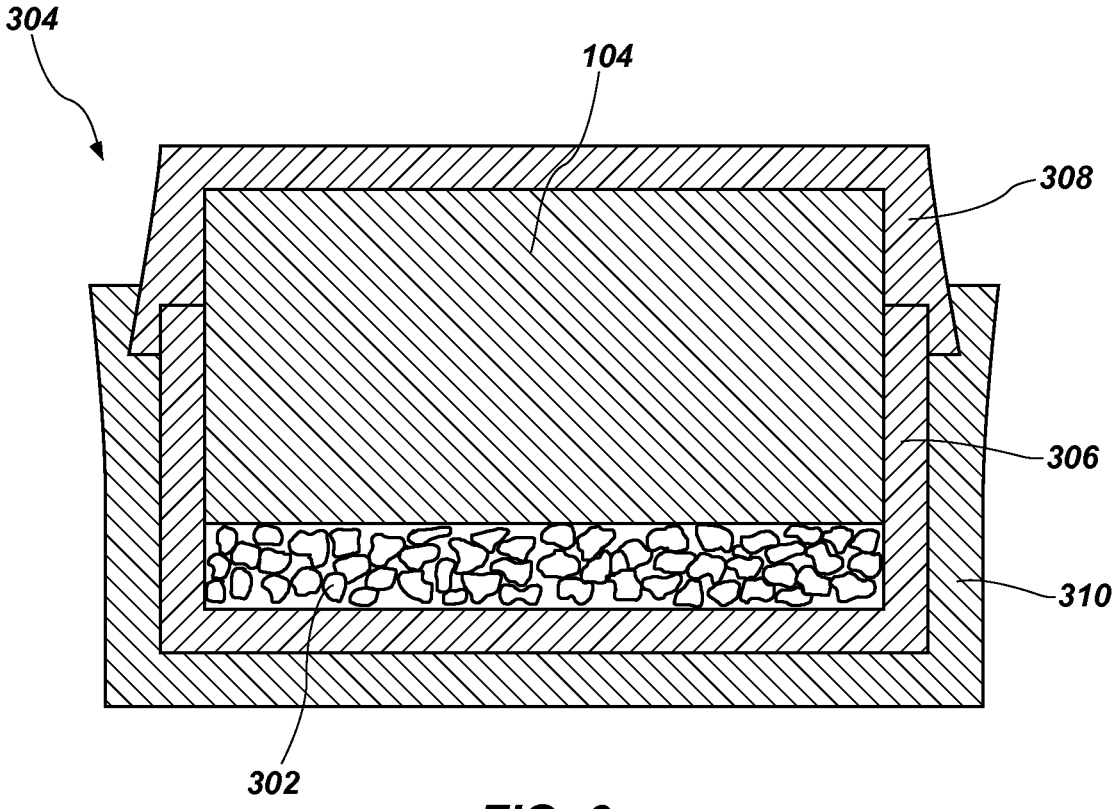
FIG. 6 is a simplified cross-sectional view illustrating materials used to form the cutting element of FIG. 1 in a container in preparation for subjecting the container to an HPHT sintering process.

Referring to FIG. 6, particles 302 of hard material having an alloy material thereon may be positioned within a container 304 (e.g., a metal canister). The particles 302 may include, for example, grains or crystals of diamond (e.g., diamond grit), which will ultimately form the grains 106, 108 in the sintered polycrystalline hard material 102 (FIG. 2). The container 304 may include an inner cup 306 in which the particles 302 may be provided. In some embodiments, a substrate 104 (e.g., as shown in FIG. 1) optionally may also be provided in the inner cup 306 over or under the particles 302, and may ultimately be encapsulated in the container 304. The container 304 may further include a top cover 308 and a bottom cover 310, which may be assembled and bonded together (e.g., swage bonded) around the inner cup 306 with the particles 302 and the optional substrate 104 therein.

In the container 304, the particles 302 may have a packing fraction from about 45% to about 99% (i.e., with a void space of between about 55% and about 1% of the total volume), such as from about 50% to about 70% (i.e., with a void space of between about 50% and about 30% of the total volume).

The container 304 with the particles 302 therein may be subjected to an HPHT process to form a polycrystalline hard material (e.g., the polycrystalline hard material 102 shown in FIG. 1). For example, the container 304 may be subjected to a pressure of at least about 4.5 GPa and a temperature of at least about 1,000° C. In some embodiments, the container 304 may be subjected to a pressure of at least about 5.0 GPa, at least about 5.5 GPa, at least about 6.0 GPa, or even at least about 6.5 GPa. For example, the container 304 may be subjected to a pressure from about 7.8 GPa to about 8.0 GPa. The container 304 may be subjected to a temperature of at least about 1,100° C., at least about 1,200° C., at least about 1,300° C., at least about 1,400° C., or even at least about 1,500° C.

During the sintering process, the alloy materials 204, 214 deposited on the grains 202, 212 may melt into a liquid phase. In the liquid phase, the alloy materials 204, 214 may behave as a metal-solvent catalyst material to promote the formation of inter-granular (e.g., diamond-to-diamond) bonds between the grains 202, 212 so as to form a polycrystalline compact from the grains 202, 212. Upon completion of the sintering process and cooling to room temperature, the alloy materials 204, 214 solidify in interstitial spaces between the grains 202, 212 in the polycrystalline hard material 102. As previously mentioned, in this solid form, the alloy material 112 (FIG. 2, which may be formed by diffusion of carbon into the alloy material(s) 204, 214) may not promote or catalyze the back-conversion of diamond to graphite at temperatures of about 1,000° C. and below.

Optionally, a portion or all of the alloy material 112 may be removed from the polycrystalline hard material 102 (see FIG. 1) after the HPHT process using processes known in the art. For example, a leaching process may be used to remove the alloy material 112 from the interstitial spaces between the grains 106, 108 in at least a portion of the polycrystalline hard material 102. By way of example and not limitation, a portion of the polycrystalline hard material 102 may be leached using a leaching agent and process such as those described more fully in, for example, U.S. Pat. No. 5,127,923, issued Jul. 7, 1992, and titled "Composite Abrasive Compact Having High Thermal Stability," and U.S. Pat. No. 4,224,380, issued Sep. 23, 1980, and titled "Temperature Resistant Abrasive Compact and Method for Making Same," the disclosure of each of which is incorporated herein in its entirety by this reference. Specifically, aqua regia (a mixture of concentrated nitric acid ($HNO_3$) and concentrated hydrochloric acid (HCl)) may be used to at least substantially remove alloy material 112 from the interstitial spaces. It is also known to use boiling HCl and boiling hydrofluoric acid (HF) as leaching agents. One particularly suitable leaching agent is HCl at a temperature of above about 110° C., which may be provided in contact with the polycrystalline hard material 102 for a period of about two (2) hours to about sixty (60) hours, depending upon the size of the body of polycrystalline hard material 102. After leaching the polycrystalline hard material 102, the interstitial spaces between the inter-bonded grains 106, 108 of hard material within the polycrystalline hard material 102 subjected to the leaching process may be at least substantially free of alloy material 112 used to catalyze formation of inter-granular bonds 110 between the grains 106, 108. The leaching process may be applied to only a portion of the polycrystalline hard material 102, or to the entire body of the polycrystalline hard material 102.

Use of an alloy material 112 as described herein may impart certain benefits to polycrystalline hard materials 102. For example, the alloy material 112 (including iridium, carbon, and at least one of copper, silver, and gold) may exhibit inert (i.e., non-catalytic) behavior when in a single-phase solid state, even at elevated temperatures, such as above about 400° C. The alloy material 112 may be formulated such that it does not form carbides.

Alloys of Cu—Ir—C, Ag—Ir—C, and Au—Ir—C(referred to generally herein as "M-Ir—C alloys") may be formulated to have relatively low melting points. For example, though pure iridium has a melting point of approximately 2,443° C., M-rich alloys containing iridium may have substantially lower melting points. Iridium is generally miscible in liquid copper, silver, and gold, so single-phase alloys may easily form with a wide range of compositions. Iridium may limit or prevent oxidation of the metals and diamond phase at high temperatures. Furthermore, M-Ir—C alloys may be relatively simply formed by applying M-Ir to diamond particles before HPHT sintering (e.g., as a coating, as described herein with respect to FIGS. 4 and 5). Additionally, iridium acts as a superior grain refiner for sputtered alloy coatings and can be sputtered in substantially pure form to sub-nanometer thicknesses.

Copper, silver, and gold are not considered alone to be effective catalysts for diamond growth and bonding. Without being bound by a particular theory, it appears that low liquid carbon solubility in copper, silver, and gold at thermobaric conditions (e.g., pressures of less than about 55 kbar and temperatures of less than about 1,500° C.) limits the use of these metals alone as catalysts. At relatively higher pressures and/or temperatures (e.g., pressures greater than about 55 kbar and temperatures from about 1,400° C. to about 1,600° C.), copper, silver, and gold may behave as catalysts due to pressure-induced changes in carbon solubility. Furthermore, other species (e.g., nickel, cobalt, iron, or iridium) in solution with liquid copper, silver, or gold may further increase carbon solubility and may promote diamond growth and bonding. Though this disclosure has generally discussed the use of iridium, metals such as nickel, cobalt, and iron may be substituted for all or a portion of the iridium to increase the carbon solubility in copper, silver, or gold at HPHT conditions. Iridium is known to have the added benefit of being a grain refiner, and therefore may be evenly coated into particles.

By providing the alloy material 112 or a precursor thereof as a coating over the grains 106, 108, the time and distance required to sweep the alloy material 112 through the grains 106, 108 may be reduced. Thus, the grains 106, 108 may be provided with a lower mean free path and, therefore, a higher packing fraction. This may result in a relatively higher final (post-sintered) density of the polycrystalline hard material 102. For example, the mean free path through the grains 106, 108 may be on the order of the diameter of the grains 106, 108 (e.g., from about 1 nm to about 20 μm) of the microstructure of the polycrystalline hard material 102, rather than the order of the thickness of the polycrystalline hard material 102 (e.g., from about 1 mm to 3.5 mm) without negatively affecting the ability of the alloy material 112 to fill the interstitial spaces. Furthermore, the alloy material 112 may be formulated to avoid oxidation in air. Conventional diamond grains may undergo back-conversion starting at temperatures of about 750° C. in air or about 1,200° C. in an inert atmosphere. Providing at least some of the grains 106, 108 with a coating material thereon may limit the time during which the grains 106, 108 are exposed to air or other gases in the HPHT process, thus limiting the time during which the grains 106, 108 may degrade (e.g., by conversion from diamond to carbon).

Furthermore, the alloy material 112 may be catalytic to carbon transformations (e.g., graphite-to-carbon or vice versa) only in liquid form. Thus, after the polycrystalline hard material 102 has been sintered and cooled below the melting point of the alloy material 112, further changes to the crystalline structure of the polycrystalline hard material 102 may occur at negligible rates. The cutting element 100 may exhibit significantly increased performance and stability in a range between the temperature at which back-conversion typically occurs (e.g., between 600° C. and 1,000° C. for catalysts based on Fe, Co, or Ni) and the melting temperature of the alloy material 112. For example, if the melting temperature of the alloy material 112 is 1,200° C., the cutting element 100 may be thermally and physically stable even at temperature of 1,100° C. or higher. Thus, a drill bit with such cutting element 100 may operate in relatively harsher conditions than conventional drill bits with lower rates of failure and costs of repair.

Additional non-limiting example embodiments of the disclosure are described below.

Embodiment 1

A method of forming polycrystalline hard material, comprising providing an alloy over at least portions of a plurality of particles of hard material, and subjecting the plurality of particles to a pressure of at least 4.5 GPa and a temperature of at least 1,000° C. to form inter-granular bonds between adjacent particles of hard material. The alloy comprises iridium and at least one metal selected from the group consisting of copper, silver, and gold.

Embodiment 2

The method of Embodiment 1, wherein providing an alloy over at least portions of a plurality of particles of hard material comprises providing the alloy over a plurality of diamond particles.

Embodiment 3

The method of Embodiment 2, further comprising selecting the alloy to be non-catalytic in solid form.

Embodiment 4

The method of any of Embodiments 1 through 3, wherein providing an alloy over at least portions of a plurality of particles of hard material comprises sputtering the alloy over the plurality of particles.

Embodiment 5

The method of any of Embodiments 1 through 4, wherein providing an alloy over at least portions of a plurality of particles of hard material comprises covering at least 30% of a surface area of the particles with the alloy.

Embodiment 6

The method of any of Embodiments 1 through 5, wherein providing an alloy over at least portions of a plurality of particles of hard material comprises covering at least 75% of a surface area of the particles with the alloy.

Embodiment 7

The method of any of Embodiments 1 through 6, wherein providing an alloy over at least portions of a plurality of particles of hard material comprises forming a layer of the alloy having a thickness from about 1 nm to about 20 nm over the particles.

Embodiment 8

The method of any of Embodiments 1 through 7, wherein providing an alloy over at least portions of a plurality of particles of hard material comprises forming a layer of the alloy having a thickness from about 1 nm to about 2 nm over the particles.

Embodiment 9

The method of any of Embodiments 1 through 8, wherein providing an alloy over at least portions of a plurality of particles of hard material comprises providing the alloy comprising copper and from about 0.001% iridium by weight of the alloy to about 15% iridium by weight of the alloy.

Embodiment 10

The method of any of Embodiments 1 through 9, wherein providing an alloy over at least portions of a plurality of particles of hard material comprises providing the alloy comprising copper and from about 5% iridium by weight of the alloy to about 11% iridium by weight of the alloy.

Embodiment 11

The method of any of Embodiments 1 through 10, wherein providing an alloy over at least portions of a plurality of particles of hard material comprises providing the alloy comprising silver and from about 0.001% iridium by weight of the alloy to about 2% iridium by weight of the alloy.

Embodiment 12

The method of any of Embodiments 1 through 11, wherein providing an alloy over at least portions of a plurality of particles of hard material comprises providing the alloy comprising silver and from about 1% iridium by weight of the alloy to about 2% iridium by weight of the alloy.

Embodiment 13

The method of any of Embodiments 1 through 12, wherein providing an alloy over at least portions of a plurality of particles of hard material comprises providing the alloy comprising gold and from about 0.001% iridium by weight of the alloy to about 2% iridium by weight of the alloy.

Embodiment 14

The method of any of Embodiments 1 through 13, wherein providing an alloy over at least portions of a plurality of particles of hard material comprises providing the alloy comprising gold and from about 1% iridium by weight of the alloy to about 2% iridium by weight of the alloy.

Embodiment 15

The method of any of Embodiments 1 through 14, wherein providing an alloy over at least portions of a plurality of particles of hard material comprises providing the alloy exhibiting a melting point of less than about 1,500° C. at atmospheric pressure.

Embodiment 16

The method of any of Embodiments 1 through 15, wherein providing an alloy over at least portions of a plurality of particles of hard material comprises providing the alloy exhibiting a melting point of less than about 1,300° C. at atmospheric pressure.

Embodiment 17

The method of any of Embodiments 1 through 16, wherein providing an alloy over at least portions of a plurality of particles of hard material comprises providing the alloy exhibiting a melting point of less than about 1,100° C.

Embodiment 18

The method of any of Embodiments 1 through 17, wherein providing an alloy over at least portions of a plurality of particles of hard material comprises providing the alloy over the plurality of particles having a multi-modal particle size distribution.

Embodiment 19

The method of any of Embodiments 1 through 18, further comprising removing at least portions of the alloy from at least portions of the polycrystalline hard material.

Embodiment 20

A method of forming polycrystalline diamond, comprising selecting an alloy that is catalytic to formation of diamond-to-diamond bonds when the alloy is in a liquid phase, providing the alloy over at least portions of a plurality of particles of diamond, and subjecting the alloy and the plurality of particles of diamond to high-pressure high-temperature (HPHT) conditions at a temperature of at least a melting temperature of the alloy to form inter-granular bonds between the particles of diamond to form polycrystalline diamond. The alloy is non-catalytic to the back-conversion of diamond to graphite at temperatures of less than about 1,000° C.

Embodiment 21

The method of Embodiment 20, wherein the alloy comprises at least one metal selected from the group consisting of copper, silver, and gold.

Embodiment 22

The method of Embodiment 21, wherein the alloy comprises at least one metal selected from the group consisting of nickel, cobalt, iron, and iridium.

Embodiment 23

The method of Embodiment 22, wherein the alloy comprises iridium.

Embodiment 24

The method of any of Embodiments 20 through 23, further comprising cooling the polycrystalline diamond and removing at least portions of the alloy from the cooled polycrystalline diamond.

Embodiment 25

A polycrystalline compact, comprising a plurality of grains of hard material bonded to one another by inter-granular bonds and an alloy disposed within interstitial spaces between the inter-bonded grains of the hard material. The alloy comprises iridium, carbon, and at least one metal selected from the group consisting of copper, silver, and gold. The alloy exhibits a melting point of less than about 1,300° C. at atmospheric pressure.

Embodiment 26

The polycrystalline compact of Embodiment 25, wherein the grains of hard material comprise diamond grains.

Embodiment 27

The polycrystalline compact of Embodiment 25 or Embodiment 26, wherein the grains of hard material comprise nanodiamond grains.

Embodiment 28

The polycrystalline compact of any of Embodiments 25 through 27, wherein the alloy comprises from about 0.1% to about 15% iridium.

Embodiment 29

The polycrystalline compact of any of Embodiments 25 through 28, wherein the alloy consists essentially of iridium, carbon, and the at least one metal selected from the group consisting of copper, silver, and gold.

Embodiment 30

The polycrystalline compact of any of Embodiments 25 through 29, wherein the alloy is substantially free of iron, cobalt, and nickel.

Embodiment 31

The polycrystalline compact of any of Embodiments 25 through 30, wherein the grains of hard material exhibit a multimodal particle size distribution.

Embodiment 32

The polycrystalline compact of any of Embodiments 25 through 31, wherein the polycrystalline compact comprises at least 90% hard material by volume.

Embodiment 33

The polycrystalline compact of Embodiment 32, wherein the polycrystalline compact comprises at least 94% hard material by volume.

Embodiment 34

An earth-boring tool comprising a bit body and the polycrystalline diamond compact of any of Embodiments 25 through 33.

Embodiment 35

An earth-boring tool comprising a bit body and a polycrystalline diamond compact secured to the bit body. The polycrystalline diamond compact comprises a plurality of grains of diamond material bonded to one another by inter-granular bonds and an alloy disposed within interstitial spaces between the inter-bonded diamond grains of the diamond matrix. The alloy comprises iridium, carbon, and at least one metal selected from the group consisting of copper, silver, and gold.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of tools and materials.

What is claimed is:

1. A method of forming polycrystalline diamond, comprising:

co-depositing iridium and at least one metal selected from the group consisting of copper, silver, and gold over at least portions of a plurality of diamond particles; and subjecting the plurality of diamond particles to a pressure of at least 4.5 GPa and a temperature of at least 1,000° C. to form an alloy of the iridium and the at least one metal selected from the group consisting of copper, silver, and gold to form inter-granular bonds between adjacent diamond particles, wherein the alloy is non-catalytic to the conversion of diamond to graphite when the alloy is in solid form.

2. The method of claim 1, wherein co-depositing iridium and at least one metal selected from the group consisting of copper, silver, and gold over at least portions of a plurality of diamond particles comprises sputtering the iridium before sputtering the metal selected from the group consisting of, copper, silver, and gold over the plurality of diamond particles.

3. The method of claim 1, wherein co-depositing iridium and at least one metal selected from the group consisting of copper, silver, and gold over at least portions of a plurality of diamond particles comprises covering at least 30% of a surface area of the diamond particles with iridium and at least one metal selected from the group consisting of copper, silver, and gold.

4. A method of forming polycrystalline diamond, comprising:

forming a layer of an alloy over at least portions of a plurality of diamond particles, wherein the alloy comprises iridium and at least one metal selected from the group consisting of copper, silver, and gold, the layer of the alloy having a thickness from about 1 nm to about 20 nm over the diamond particles; and subjecting the plurality of diamond particles to a pressure of at least 4.5 GPa and a temperature of at least 1,000° C. to form inter-granular bonds between adjacent diamond particles.

5. A method of forming polycrystalline diamond, comprising:

providing an alloy over at least portions of a plurality of diamond particles, wherein the alloy comprises copper and from about 0.001% iridium by weight of the alloy to about 15% iridium by weight of the alloy; and subjecting the plurality of diamond particles to a pressure of at least 4.5 GPa and a temperature of at least 1.000° C. to form inter-granular bonds between adjacent diamond particles.

6. The method of claim 1, wherein co-depositing iridium and at least one metal selected from the group consisting of copper, silver, and gold over at least portions of a plurality of diamond particles comprises providing an alloy comprising silver and from about 0.001% iridium by weight of the alloy to about 2% iridium by weight of the alloy.

7. The method of claim 1, wherein co-depositing iridium and at least one metal selected from the group consisting of copper, silver, and gold over at least portions of a plurality of diamond particles comprises providing an alloy comprising gold and from about 0.001% iridium by weight of the alloy to about 2% iridium by weight of the alloy.

8. The method of claim 1, wherein co-depositing iridium and at least one metal selected from the group consisting of copper, silver, and gold over at least portions of a plurality of diamond particles comprises providing an alloy exhibiting a melting point of less than about 1,300° C. at atmospheric pressure.

9. The method of claim 1, wherein co-depositing iridium and at least one metal selected from the group consisting of copper, silver, and gold over at least portions of a plurality of diamond particles comprises providing an alloy over the plurality of diamond particles having a multi-modal particle size distribution.

10. A method of forming polycrystalline diamond, comprising:

providing an alloy over at least portions of a plurality of diamond particles, wherein the alloy comprises iridium and at least one metal selected from the group consisting of copper, silver, and gold;

subjecting the plurality of diamond particles to a pressure of at least 4.5 GPa and a temperature of at least 1,000° C. to form inter-granular bonds between adjacent diamond particles; and removing at least a portion of the alloy from at least a portion of the polycrystalline diamond.

11. A method of forming polycrystalline diamond, comprising:

selecting an alloy that is catalytic to formation of diamond-to-diamond bonds when the alloy is in a liquid phase, wherein the alloy is non-catalytic to the back-conversion of diamond to graphite at temperatures of less than about 1,000° C.;

providing the alloy over at least portions of a plurality of particles of diamond; and subjecting the alloy and the plurality of particles of diamond to high-pressure high-temperature (HPHT) conditions at a temperature of at least a melting temperature of the alloy to form inter-granular bonds between the particles of diamond to form polycrystalline diamond.

12. The method of claim 11, wherein the alloy comprises iridium and at least one metal selected from the group consisting of copper, silver, and gold.

13. The method of claim 11, wherein the alloy comprises iridium.

14. A polycrystalline diamond compact, comprising:

a plurality of grains of diamond bonded to one another by inter-granular bonds; and an alloy disposed within interstitial spaces between the inter-bonded diamond grains, the alloy comprising iridium, carbon, and at least one metal selected from the group consisting of copper, silver, and gold, wherein the alloy exhibits a melting point of less than about 1,300° C. at atmospheric pressure.

15. The polycrystalline compact of claim 14, wherein the grains of diamond comprise nanodiamond grains.

16. The polycrystalline diamond compact of claim 14, wherein the alloy comprises from about 0.1% to about 15% iridium.

17. The polycrystalline diamond compact of claim 14, wherein the alloy is substantially free of iron, cobalt, and nickel.

18. The polycrystalline diamond compact of claim 14, wherein the polycrystalline diamond compact comprises at least 94% diamond by volume.

19. An earth-boring tool comprising:

a bit body; and the polycrystalline diamond compact of claim 14.

* * * * *